US006284990B1

(12) United States Patent
Arnold et al.

(10) Patent No.: US 6,284,990 B1
(45) Date of Patent: Sep. 4, 2001

(54) BORE RIDER SWITCH

(75) Inventors: Douglas G. Arnold, Wakefield, RI (US); William A. Hardin, Westport, MA (US); Michael J. Wroblewski, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/882,002

(22) Filed: May 19, 1997

(51) Int. Cl.[7] ..... H01H 35/00

(52) U.S. Cl. ..... 200/52 R; 200/61.42; 200/81.9 R; 102/262; 102/420

(58) Field of Search ..... 200/52 R, 81.9 R, 200/545, 61.42; 114/20.1, 23; 102/262–264, 420; 89/1.1

(56) References Cited

U.S. PATENT DOCUMENTS 1,897,863 * 2/1933 Ruhlemann ..... 200/61.42
2,428,565 * 10/1947 Guidosh ..... 200/81.9 R
2,589,547 * 3/1952 Hughes et al. ..... 200/81.9 R
2,787,957 * 4/1957 Dippel ..... 114/20.1 X
3,004,506 * 10/1961 Cooke et al. ..... 114/20.1
3,618,066 * 11/1971 Brammont ..... 200/61.42 X
3,710,048 * 1/1973 Schumacher ..... 200/52 R
4,394,556 * 7/1983 Gould ..... 200/545

* cited by examiner

*Primary Examiner*—J. R. Scott
(74) *Attorney, Agent, or Firm*—Michael J. McGowan; Robert W. Gauthier; Prithvi C. Lall

(57) ABSTRACT

A safety switch is provided to detect when a tube launched which exits the tube. The switch is located within the vehicle having a switch plunger extending to the periphery of the vehicle. The plunger is biased to provide outward pressure against a lever on the exterior of the vehicle. The lever rides within the bore of the launch tube such that, when the vehicle is within the launch tube, the lever contacts the interior bore of the tube. The lever contacting the tube bore prevents the plunger from extending to activate the switch. When the vehicle exits the tube, the lever is free to rotate away from the vehicle allowing the plunger to extend and activate the switch which may be a single or multi-pole switch.

13 Claims, 2 Drawing Sheets

BORE RIDER SWITCH

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to safety switches, and more particularly to a passive switch assembly mounted on an unmanned, tube launched vehicle which, by interaction with the bore of the vehicle launch tube, identifies whether the vehicle is in or out of the launch tube.

(2) Description of the Prior Art

In most applications when an unmanned vehicle is launched from a tube, the safety logic of the vehicle does not allow the vehicle to begin operation until the vehicle is clear of the launch tube. In the case of an underwater vehicle being launched by an impulse of high pressure water from a ram, the typical safety logic senses the correct acceleration from the impulse and detects the presence of seawater when an umbilical cable or lanyard breaks away from the vehicle. However, during some phases of testing, it may be desirable to have the vehicle swim out of the tube under much lower pressure. The current safety logic would prevent the operation of the vehicle under these conditions. In addition, it may be necessary to have the umbilical remain attached to the vehicle in order to provide power to the vehicle or to obtain run-time measurements until the umbilical breaks. Again under these conditions, the safety logic would prevent the operation of the vehicle. Further, the reliance of the safety logic on the separation of an umbilical cord or lanyard may present unnecessary hazards to the operation of the vehicle. The umbilical cord or lanyard may become entangled in the propulsion unit of the vehicle which may lead to a false tube exit signal. Also, routing of a lanyard within the confines of a launch tube may be difficult and may require special considerations with respect to the launch method used.

A number of prior art safety devices for tube launched underwater vehicles are actuated as a result of the vehicle entering the water with sufficient forward velocity, e.g., U.S. Pat. No. 2,428,565 to Guidosh, U.S. Pat. No. 2,589,547 to Hughes et al. and U.S. Pat. No. 2,787,957 to Dippel. As with prior art devices relying on sensing proper acceleration, devices relying on the flow of water will not operate properly for a vehicle allowed to swim out of the launch tube nor will they operate when a vehicle is launched in the air.

Cooke et al., U.S. Pat. No. 3,004,506, provide a safety switch which does not depend on water flow for activation. The switch has two levers which are interconnected at a bearing. The first lever is pinned to a switch plunger and the second lever is pinned to the vehicle housing. The switch plunger is spring biased to pull down and rotate the first lever. When the vehicle is in the launch tube, the second lever is in contact with the inside of the tube which prevents it from rotating and, due to the interconnecting bearing, also prevents the first lever from rotating under the influence of the spring biased plunger. When the vehicle exits the launch tube, the second lever is free to rotate which allows the second lever to rotate, leading to the switch plunger moving away from the switch contacts thus activating the switch. While the Cooke et al. switch overcomes some of the disadvantages of other prior art switches, the two levers, the bearing connection and the cam-like action of the second lever and switch plunger connection present a complex design with an increased probability of failure. Fouling or corrosion between the levers, at the bearing connection, or at the lever-plunger connection can prevent the proper operation of the Cooke et al. switch.

SUMMARY OF THE INVENTION

Accordingly, it is an object of the present invention to provide a safety switch which indicates when a tube launched vehicle has exited the tube without relying on the use of a lanyard or umbilical cord.

Another object of the present invention is to provide a safety switch which does not depend on sensing a velocity or acceleration pressure.

Still another object of the present invention is to provide a safety switch having a simplified design more resistant to fouling and corrosion failures.

Other objects and advantages of the present invention will become more obvious hereinafter in the specification and drawings.

In accordance with the present invention, a safety switch is provided for a tube launched vehicle in the form of a bore rider switch. The switch is located within the vehicle with the switch plunger extending to the periphery of the vehicle. The plunger is biased to provide outward pressure against a lever on the exterior of the vehicle. When the vehicle is within the launch tube, the lever is in contact with the interior bore of the tube which works against the bias of the plunger to keep the switch deactivated. When the vehicle exits the tube, the lever is free to rotate away from the vehicle allowing the plunger to extend and activate the switch which may be a single or multi-pole switch.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1A:
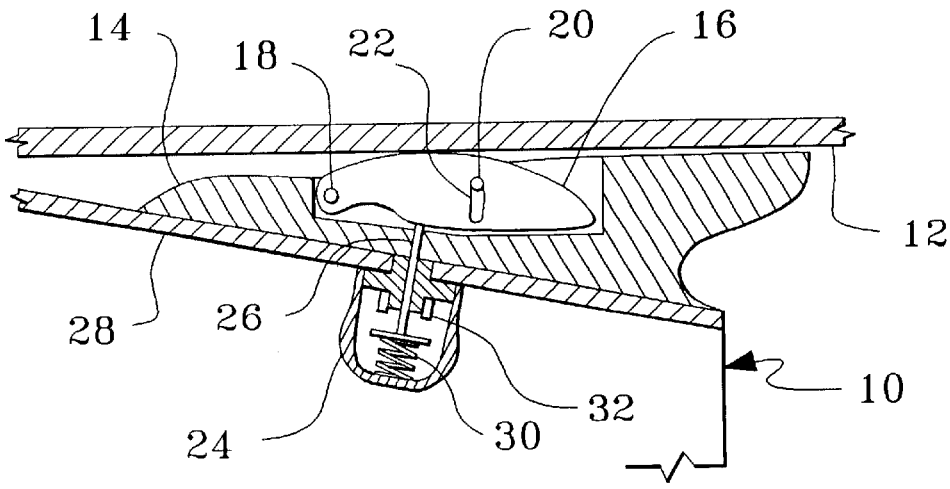
FIG. 1A is a partial longitudinal section of a vehicle within a launch tube with the bore rider switch of the present invention.
Figure 1B:
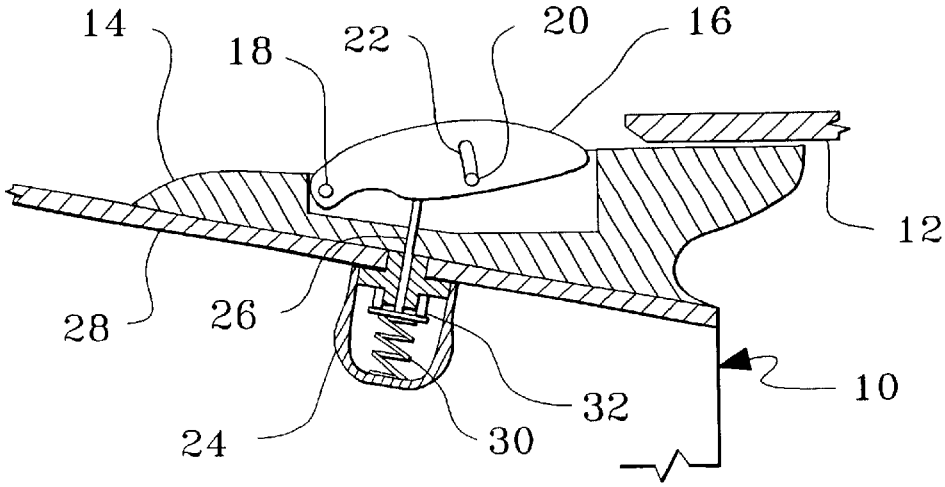
FIG. 1B is a partial longitudinal section of the vehicle of FIG. 1A shown as it exits the launch tube.

Referring now to FIG. 1A, there is shown a partial longitudinal cross section of a vehicle 10 within its launch tube 12. As is typical of most tube launched vehicle, vehicle 10 has a streamlined shape having one or more vanes 14 providing for stability or maneuverability while the vehicle is moving through a medium. In the preferred embodiment of FIG. 1A, cam follower 16 is provided within vane 14. Pin 18 connects cam follower 16 to vane 14 with cam follower 16 able to rotate about pin 18. A removable pin 20, preferably fixed by interference fit into vane 14, projects from vane 14 through cam slot 22 within cam follower 16 to restrict rotation of cam follower 16 to within the arc described by cam slot 22. Bore rider switch 24 is located within vehicle 10. Plunger 26 of switch 24 extends through shell 28 of vehicle 10 to be in contact with cam follower 16. Plunger 26 is biased to exert an outward force against cam follower 16 and presses cam follower 16 against the interior bore of tube 12. In the preferred embodiment shown, the bias is provided by spring 30. In the position shown in FIG. 1A, plunger 26 is depressed within switch 24, so as not to make contact with switch contact 32 of bore rider switch 24. Referring now to FIG. 1B, vehicle 10 is shown exiting tube 12, with cam follower 16 outside of tube 12. The bias of plunger 26 rotates cam follower 16 about pin 18 such that plunger 26 extends, making contact with switch contact 32 and activating bore rider switch 24 to indicate that vehicle 10 has left tube 12. It can be seen upon examination of FIGS. 1A and 1B that cam follower 16 is shaped such that it is easily depressed when vehicle 10 is loaded into tube 12 in either direction.

Figure 2:
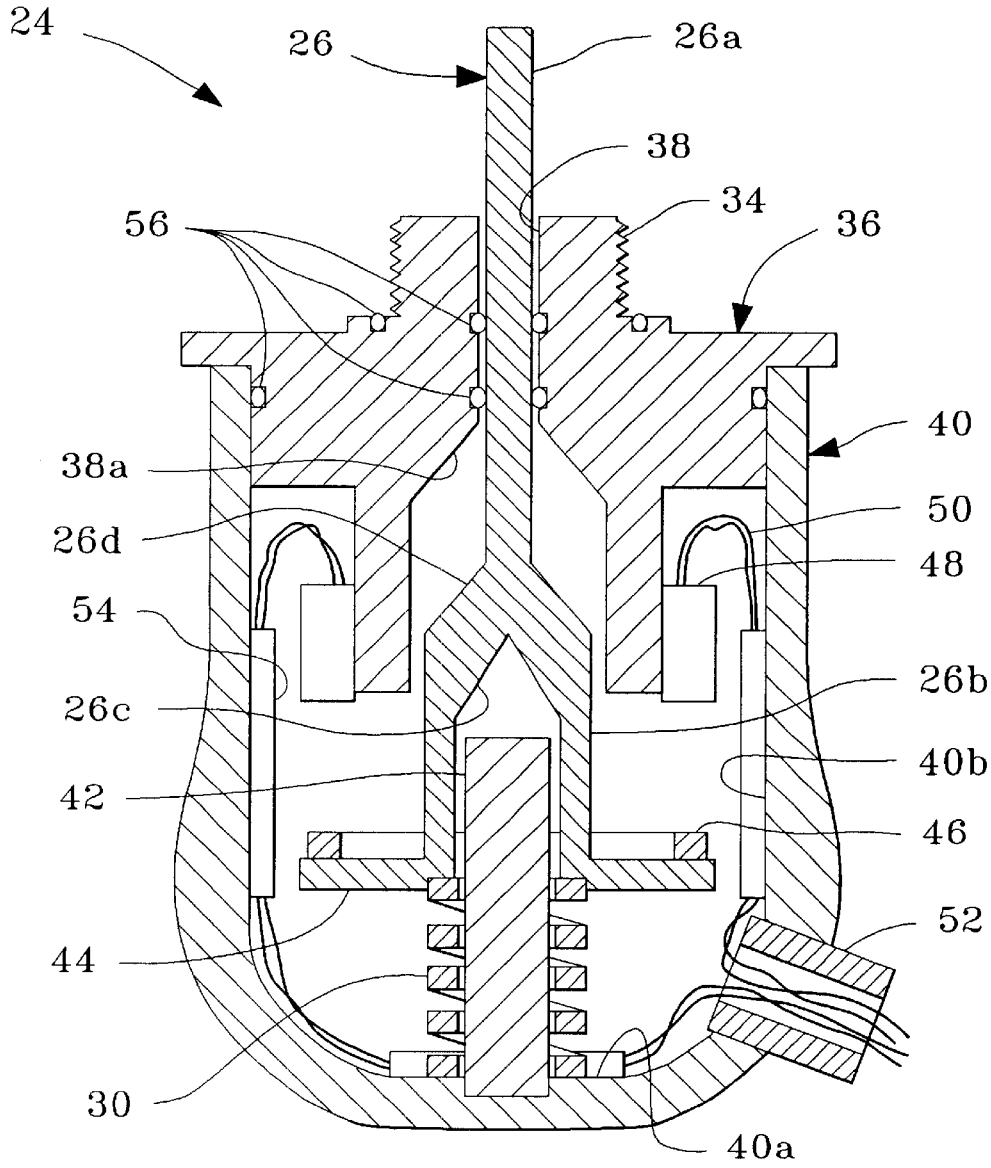
FIG. 2 is sectional detailed view of bore rider switch of the present invention.

Referring now to FIG. 2, a cross section of the preferred embodiment of switch 24 is shown in greater detail. A threaded extension 34 on switch base 36 attaches switch 24 to vehicle shell 28 (not shown in FIG. 2). Plunger 26 has a first end 26*a* extending through switch bore 38 in switch base 36 to contact cam follower 16 (not shown in FIG. 2). Second or opposite end 26*b* of plunger 26 is within main switch housing 40 with switch base 36 being removably attached to switch housing 40. Spring 30 is coiled around spring guide rod 42 and extends between housing base 40*a* of switch housing 40 and flange 44 at second end 26*b* of plunger 26. FIG. 2 shows plunger 26 partially depressed within housing 40 with spring 30 compressed, as is shown in FIG. 1A when vehicle 10 is within launch tube 12. A relief bore 26*c* is provided in plunger 26 to accommodate guide rod 42 when plunger 26 is depressed. Flange 44 has a larger diameter than switch bore 38 preventing plunger 26 from passing completely through switch bore 38 and also providing a surface for attachment of contact ring 46. One or more micro switches 48 are mounted to switch base 36 within housing 40 with electrical leads 50 passing along the interior periphery 40*b* of housing 40 and out through cable housing 52. Lead raceways 54 are provided within housing 40 to protect leads 50 from becoming entangled with spring 30. O-rings 56 are provided about plunger 26 and switch base 36 to properly seal the interior of switch housing 40.

When vehicle 10 exits launch tube 12, spring 30 extends to push plunger 26 further through bore 38 until contact ring 46 on flange 44 makes contact with and activates micro switches 48. In the preferred embodiment shown in FIG. 2, plunger 26 is thickened at second end 26*b* and the diameter of switch bore 38 is increased at its end within housing 40 such that plunger shoulders 26*d* would contact bore shoulders 38*a* to further prevent plunger 26 from passing through bore 38 should flange 44 fail. Depending on the sophistication of the operational systems within vehicle 10, micro switches 48 can be made to simply provide notification to the operational systems that the vehicle has cleared the tube, or individual micro switches 48 can be arranged to directly begin activation of separate operational functions within vehicle 10. Micro switches 48 can be wired for two position operation to allow functions to occur either while vehicle 10 is in tube 12 or after vehicle 10 exits from tube 12.

The bore rider switch thus described provides a simple means for determining when a tube launched vehicle has exited the launch tube. The switch does not depend upon the use of a lanyard or umbilical detaching from the vehicle thus preventing possible entanglement of the lanyard within the propulsion unit of the vehicle. Nor does the bore rider switch depend on sensing acceleration or forward velocity of the vehicle allowing it to be used when the vehicle merely swims out of the tube rather than being forced out under pressure. Further, the switch has a simple cam follower pinned at one end to the vehicle, presenting much less opportunity for fouling and subsequent failure of the switch.

Although the present invention has been described relative to a specific embodiment thereof, it is not so limited. The exact materials and shapes described can be modified to suit the vehicle being outfitted. Rather than have a pin engage a slot within the cam follower, the cam follower can be a simple rotatable lever with a stop engaging the vane to prevent over rotation of the lever. Also, when the launch tube has a smooth bore and care is taken in loading the vehicle in the tube, the cam follower or lever could be removed such that the plunger makes direct contact with the tube. A roller can be mounted to the end of the plunger to facilitate movement of the vehicle within the tube. Other means, such as pressurized gases sealed within housing 40 or hydraulics, may be used to bias the plunger against the cam follower. Further, the use of a hydraulic fluid sealed within housing 40 to dampen movement of the plunger may be used to delay the switch response at tube exit. The compressed gas or hydraulic fluid of the foregoing embodiments is denoted as 58 in FIG. 2.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A bore rider switch mounted within a vehicle, the vehicle being capable of being launched from a tube, the switch providing a signal when the vehicle exits the tube, the switch comprising:

a mounting for attaching the switch within the vehicle;

a plunger movable in relation to the mounting, the plunger having a first end interacting with an interior surface of the tube when the vehicle is within the tube;

at least one first contact attached to and moving with the plunger;

at least one contact switch means attached to the mounting, the contact switch means being in an open position when the plunger end is interacting with the interior surface of the tube; and biasing means for biasing the at least one first contact in a direction towards the at least one contact switch means, the direction corresponding with movement of the plunger end away from the vehicle and towards the interior surface, the interaction of the plunger end and the interior surface of the tube maintaining a separation between the at least one first contact and the at least one contact switch means, the exiting of the vehicle from the tube allowing the biasing means to move the plunger in relation to the mounting, the movement forcing the at least one first contact against the at least one contact switch means to place the at least one contact switch means in a closed position, the closed position completing a circuit for providing the signal.

2. The switch of claim 1 further comprising a lever interspersed between the plunger and the tube, the lever being rotatably attached to the vehicle at a point distant from the plunger, the lever rotating to allow the movement of the plunger when the vehicle exits the tube.

3. The switch of claim 2 wherein the switch further comprises a pin attached to the vehicle, the pin engaging a slot on the lever to limit the rotation of the lever.

4. The switch of claim 2 wherein the lever is attached to a control vane on the vehicle, the lever being shaped to conform to the shape of the vane.

5. The switch of claim 3 wherein the lever is shaped to permit the vehicle to be inserted into the tube without interference.

6. The switch of claim 1 wherein the mounting further comprises:

a base for mounting the switch to the vehicle, the base having a bore therethrough; and a body having an open interior volume for containing the at least one contact switch means and the biasing means, the body being removably affixed to the base, the plunger having a first portion outside the vehicle and extending through the bore in the base, the first portion for interacting with the interior surface of the tube, the plunger having a second portion extending into the interior volume of the body, the at least one first contact being attached to the second portion.

7. The switch of claim 6 wherein the second portion further comprises a flange having a larger diameter than the bore for preventing the second portion from passing through the bore.

8. The switch of claim 6 wherein the body further comprises a cable housing for routing at least one signal lead from the at least one contact switch means to control circuitry within the vehicle.

9. The switch of claim 8 wherein the body further comprises at least one signal lead raceway within the interior volume of the body for routing the at least one signal lead from the at least one contact switch means to the cable housing, the at least one signal lead raceway shielding the at least one signal lead from the biasing means.

10. The switch of claim 6 wherein the biasing means comprises a spring extending between the body and the second portion of the plunger, the spring exerting a force on the second portion of the plunger to move the plunger through the bore.

11. The switch of claim 6 wherein the biasing means comprises compressed gas within the interior volume of the body, a pressure of the gas exerting a force on the plunger to move the plunger through the bore.

12. The switch of claim 1 wherein the biasing means further comprises a damping means to delay the movement of the at least one first contact against the at least one contact switch means.

13. A bore rider switch mounted within a vehicle, the vehicle being capable of being launched from a tube, the switch providing a signal when the vehicle exits the tube, the switch comprising:

a mounting for attaching the switch within the vehicle, the mounting having a bore therethrough;

a body having an open interior volume and being removably affixed to the mounting within the vehicle;

at least one micro switch attached to the mounting within the interior volume of the body;

a plunger movable in relation to the mounting, the plunger having a first portion outside the vehicle and extending through the bore in the mounting, the first portion for interacting with the interior surface of the tube when the vehicle is within the tube, the plunger having a second portion extending into the interior volume of the body;

a flange attached to the plunger second portion, the flange having diameter larger than the bore to prevent the plunger second portion from passing through the bore;

spring means extending between the body and the flange for biasing the plunger to move in a direction through the bore to interact with the interior surface of the tube, the plunger movement causing the flange to move towards the at least one micro switch, the interaction of the plunger with the interior surface of the tube maintaining a separation between the flange and the at least one micro switch, the exiting of the vehicle from the tube allowing the biasing means to move the plunger further through the bore, the further movement bringing the flange in contact with the at least one micro switch, the contact activating the micro switch to provide the signal.

* * * * *

UNITED STATES PATENT AND TRADEMARK OFFICE

CERTIFICATE OF CORRECTION

PATENT NO. : 6,284,990 B1 
DATED : September 4, 2001
INVENTOR(S) : Douglas G. Arnold et al.

It is certified that error appears in the above-identified patent and that said Letters Patent is hereby corrected as shown below:

Title page,
Item [57], ABSTRACT,
Line 1, after "launched", insert -- vehicle --; and
Line 2, delete "which".

Signed and Sealed this

Ninth Day of July, 2002

*Attest:*

*Attesting Officer*

JAMES E. ROGAN
*Director of the United States Patent and Trademark Office*